US006105654A

United States Patent [19]

Martel

[11] Patent Number: 6,105,654

[45] Date of Patent: Aug. 22, 2000

[54] COOLER INSERT

[76] Inventor: Paul A. Martel, 10014 Glen Meadow Rd., Louisville, Ky. 40241

[21] Appl. No.: 09/067,643

[22] Filed: Apr. 27, 1998

[51] Int. Cl.[7] ..... A47G 5/00; B65D 25/04; B65D 57/00; E06B 9/00

[52] U.S. Cl. ..... 160/135; 16/225; 16/260; 160/352; 220/531; 220/552

[58] Field of Search ..... 220/531, 528, 220/529, 552, 530; 160/135, 351, 352; 52/70, 71, 664; 312/348.3, 183; 16/DIG. 13, 225, 227, 259, 260, 365

[56] References Cited

U.S. PATENT DOCUMENTS

| | | | |
|---|---|---|---|
| 705,270 | 7/1902 | Meyer . | |
| 941,013 | 11/1909 | Doble et al. | 220/6 |
| 1,696,349 | 12/1928 | Fritz . | |
| 2,168,969 | 8/1939 | Bickerstaff . | |
| 2,400,608 | 5/1946 | Shearer | 16/365 |
| 2,559,121 | 7/1951 | Hertzberg | 220/592.03 X |
| 2,605,926 | 8/1952 | Casey | 220/840 |
| 2,682,964 | 7/1954 | Toadvine . | |
| 2,732,581 | 1/1956 | Heck | 220/840 |
| 2,887,154 | 5/1959 | Morningstar et al. | 160/352 X |
| 3,651,851 | 3/1972 | Curtis . | |
| 4,232,724 | 11/1980 | Brown | 16/224 |
| 4,286,440 | 9/1981 | Taylor . | |
| 4,307,581 | 12/1981 | Reid . | |
| 4,403,483 | 9/1983 | Lisalda . | |
| 4,424,687 | 1/1984 | Morgan . | |
| 4,515,421 | 5/1985 | Steffes . | |
| 4,551,988 | 11/1985 | Petrantoni . | |
| 4,603,452 | 8/1986 | Paciorek | 16/262 |
| 4,667,484 | 5/1987 | Tarozzi et al. . | |
| 4,747,274 | 5/1988 | Duemmig-Zitzmann . | |
| 4,773,437 | 9/1988 | Glutting | 160/351 X |
| 4,880,210 | 11/1989 | Cucksey | 52/71 X |
| 4,916,923 | 4/1990 | Adams et al. . | |
| 4,918,786 | 4/1990 | Perry | 16/365 |
| 4,924,931 | 5/1990 | Miller | 160/351 X |
| 4,964,528 | 10/1990 | Wagoner . | |
| 5,062,540 | 11/1991 | Jenkins | 220/528 X |
| 5,074,777 | 12/1991 | Garner | 425/289 |
| 5,107,652 | 4/1992 | Sosa | 52/71 X |
| 5,437,165 | 8/1995 | White et al. . | |
| 5,502,930 | 4/1996 | Burkette et al. | 16/225 X |
| 5,522,239 | 6/1996 | Schwartz et al. . | |
| 5,526,972 | 6/1996 | Frazier et al. . | |
| 5,603,219 | 2/1997 | Kolb . | |
| 5,605,056 | 2/1997 | Brown et al. . | |

FOREIGN PATENT DOCUMENTS

| | | | |
|---|---|---|---|
| 1279245 | 6/1972 | United Kingdom | 220/6 |
| 2127780 | 4/1984 | United Kingdom | 220/528 |

*Primary Examiner*—Allan N. Shoap
*Assistant Examiner*—Joe Merek
*Attorney, Agent, or Firm*—Middleton & Reutlinger; Charles G. Lamb

[57] ABSTRACT

A cooler partition providing a top side, a bottom side being in spaced relation to the top side, a first side connecting a first distal end of the top side to a first distal end of the bottom side, a second side being in spaced relation to the first side, the second side connecting a second distal end of the top side to a second distal end of the bottom side, a center portion having a plurality of openings therethrough, at least one clamp projecting outwardly from the first side, the clamp having first and second opposed side portions, the first side portion and the second side portion being in spaced relation to one another and defining a post-receiving pocket therebetween, and, at least one hinge provided in the second side, the at least one hinge including a post and a clamp-receiving slot provided through the insert between the post and the center portion.

12 Claims, 5 Drawing Sheets

COOLER INSERT

BACKGROUND OF THE INVENTION

1. Technical Field of the Invention

The present invention relates to containers for receiving therein food articles to be maintained at a substantially constant temperature. More particularly, the present invention relates to a container for receiving therein food articles to be maintained at a substantially constant temperature, wherein the container includes a removable insert defining a plurality of discrete storage regions within the container.

2. Description of the Related Art

Thermally-insulated containers, such as coolers, ice chests and the like, are generally known in the prior art to provide a portable storage device for food articles, such as milk or other dairy products, sandwich meat, carbonated beverages, or the like, whereby the food articles may be deposited therein, surrounded by a cooling agent, such as an ice block, a supply of ice cubes, or the like, and maintained at a substantially constant temperature to prevent spoilage thereof. It is therefore desirable to provide a container for receiving and storing therein a plurality of food articles, whereby the food articles are maintained at a substantially constant temperature.

Oftentimes, the container simply defines a single storage chamber, into which both the food articles and the cooling agent are deposited and permitted to loosely intermingle, whereby the food articles and the cooling agent substantially contact one another to provide optimum cooling of the food articles by the cooling agent. An individual typically first deposits the food articles within the container and then deposits the cooling agent into the remaining space of the container between and around the food articles. For example, ice cubes, which typically include small dimensions, are thereby permitted to fall loosely above, between and around the food articles to contact each food article on numerous surfaces thereof, thereby providing the desired cooling. It is therefore desirable to provide a container for receiving and storing therein a plurality of food articles, whereby the food articles are permitted to directly contact a cooling agent to maintain a substantially constant temperature.

However, permitting the food articles to loosely intermingle and contact the cooling agent oftentimes prevents an individual from removing one food article for use and replacing it in the exact location from which it was removed. For example, a milk carton, which has been deposited within the container and is surrounded on numerous sides by ice cubes, will not be permitted to return to its original location after a first removal thereof therefrom. Once the milk carton is removed a first time, the ice cubes which theretofore surrounded the milk carton, will fall freely into the space created by the absence of the milk carton. This is particularly troublesome when the article of food is of the type designed for bulk storage and repeated use, such as, for example, a milk carton, a 2-liter bottle of carbonated beverage, or the like. Thus, it is desirable to provide a container for receiving and storing therein a plurality of food articles, wherein the food articles may be removed therefrom and replaced therein in substantially the same location.

For example, U.S. Pat. No. 4,551,988 to Petrantoni teaches a chambered cooler having a plurality of rigidly-formed baskets having predefined shapes and being removably positioned therein for receiving articles of food respectively therein and for segregating the articles of food received in one basket from the articles of food received in another basket. However, it is further desirable to provide a container for receiving and storing therein a plurality of food articles, wherein the container is provided with a removable insert, and wherein the removable insert includes a plurality of connectable wall segments adaptable to define a plurality of shapes thereby. It is even further desirable to provide a removable insert for use in a container for receiving and storing therein a plurality of food articles, wherein the removable insert includes a plurality of connectable wall segments adaptable to define a plurality of shapes thereby.

SUMMARY OF THE INVENTION

The present invention is for a cooler having an insert therein to divide a storage chamber provided within the cooler into a plurality of discrete storage regions. The insert includes a plurality of connectable wall segments adaptable to define a plurality of shapes thereby. Each wall segment includes a first side which is hingedly connected to a second side of another wall segment. The wall segments may be either substantially planer, in which case, connecting a plurality of wall segments may define an insert having a shape of a polygon, or may be arcuate, in which case, connecting a plurality of wall segments may define an insert having a complex shape which is circular, elliptical, arcuate. Alternatively, both planar wall segments may be connected to arcuate wall segments to form an insert having a complex shape.

It is an object of the present invention to provide a container for receiving and storing therein a plurality of food articles, whereby the food articles are maintained at a substantially constant temperature.

It is another object of the present invention to provide a container for receiving and storing therein a plurality of food articles, whereby the food articles are permitted to directly contact a cooling agent to maintain a substantially constant temperature.

It is yet another object of the present invention to provide a container for receiving and storing therein a plurality of food articles, wherein the food articles may be removed therefrom and replaced therein in substantially the same location.

It is still another object of the present invention to provide a container for receiving and storing therein a plurality of food articles, wherein the container is provided with a removable insert, and wherein the removable insert includes a plurality of connectable wall segments adaptable to define a plurality of shapes thereby.

It is still another object of the present invention to provide a removable insert for use in a container for receiving and storing therein a plurality of food articles, wherein the removable insert includes a plurality of connectable wall segments adaptable to define a plurality of shapes thereby.

These and other objects, features and advantages of the present invention will become apparent to those skilled in the art upon reading the ensuing detailed description in conjunction with the drawings.

A cooler partition according to a preferred embodiment of the present invention includes a top side, a bottom side being in spaced relation to the top side, a first side connecting a first distal end of the top side to a first distal end of the bottom side, a second side being in spaced relation to the first side, the second side connecting a second distal end of the top side to a second distal end of the bottom side, a center portion having a plurality of openings therethrough, at least one clamp projecting outwardly from the first side, the clamp having first and second opposed side portions, the first side portion and the second side portion being in spaced relation to one another and defining a post-receiving pocket therebetween, and, at least one hinge provided in the second side, the at least one hinge including a post and a clamp-receiving slot provided through the insert between the post and the center portion.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENTS

The following detailed description is provided to enable any person skilled in the art to make and use the present invention and sets forth the best mode contemplated by the inventor for carrying out the invention.

Figure 1:
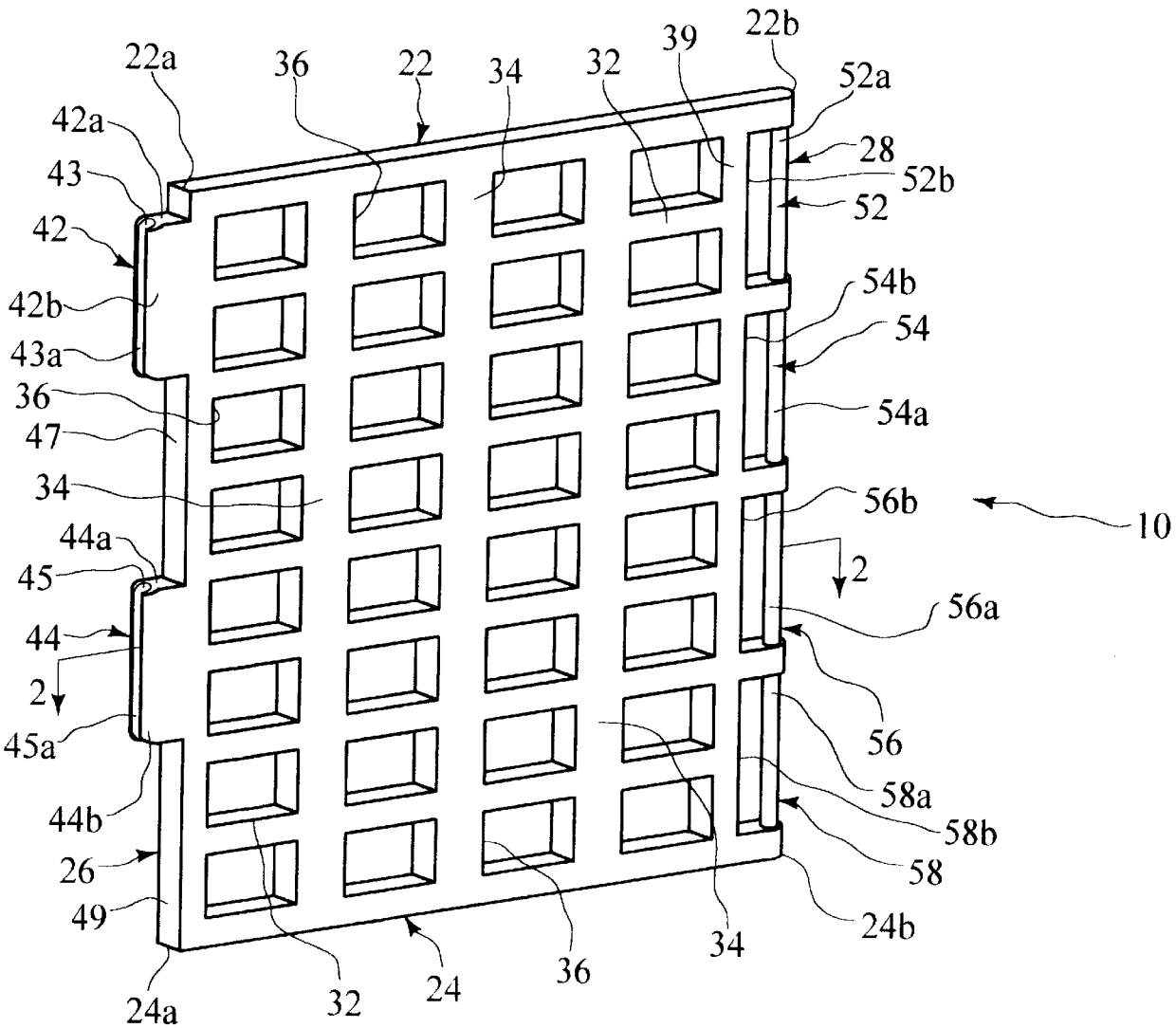
FIG. 1 is a perspective view of a cooler insert wall segment according to a preferred embodiment of the present invention.
Figure 2:
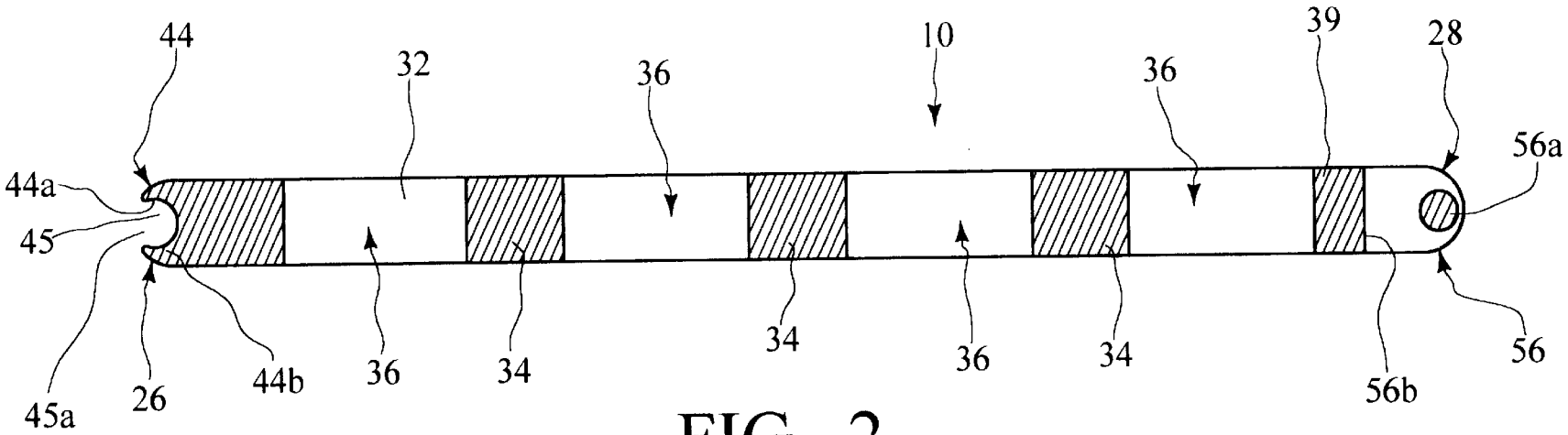
FIG. 2 is a section view of the cooler insert wall segment of FIG. 1, shown along section line 2—2 of FIG. 1.

With reference to FIG. 1, a cooler insert wall segment 10 according to a preferred embodiment of the present invention is substantially planar and includes top and bottom spaced-apart sides 22, 24, a first side 26 connecting respective first distal ends 22*a*, 24*a* of the top and bottom sides 22, 24, respectively, and a second side 28 connecting respective second distal ends 22*b*, 24*b* of the top and bottom sides 22, 24, respectively. The top and bottom sides 22, 24 cooperate with the first and second sides 26, 28 to define a substantially frame-shaped structure having a center portion coextensively therebetween. Preferably, the wall segment 10 is constructed from an integrally-molded, thermal-setting polymer, such as, for example, polyethylene or polypropylene. However, any suitable material may be substituted in place thereof without departing from either the spirit or the scope of the present invention.

A plurality of horizontal screen members 32 are integrally-molded with, and extend longitudinally between the first and second sides 26, 28 in spaced relation to one another between the top and bottom sides 22, 24. A plurality of vertical screen members 34 are integrally-molded with, and extend longitudinally between the top and bottom sides 22, 24 in spaced relation to one another between the first and second sides 26, 28. The horizontal screen members 32 intersect, and are integrally-molded with, each of the vertical screen members 34, thereby defining a center screen portion of the wall segment 10 having a plurality of openings 36 therethrough. The screen members 32, 34 are spaced such that the screen openings 36 defined thereby have a size, for example, less than 0.25 inches, sufficiently small to prevent ice cubes typical of those used as described herein from passing therethrough. The screen members 32, 34 may include a thickness equal to the thickness of the sides 22, 24, 26, 28, or may have a thickness which is less than the thickness of the sides 22, 24, 26, 28.

The first side 26 includes at least one, and preferably two, lateral clamps 42, 44 integrally-molded therewith and projecting outwardly therefrom. The first clamp 42 is positioned along the first side 26 near the top side 22; the second clamp 44 is positioned along the first side 26 downwardly adjacent a mid-point thereof. The first and second clamps 42, 44 cooperate to define a space 47 therebetween upwardly adjacent the mid-point of the first side 26.

The first clamp 42 includes a first tapered side portion 42*a* and a second tapered side portion 42*b* being opposed to the first side portion 42*a* and defining a first substantially cylindrical pocket 43 therebetween. Outermost ends of the first and second side portions 42*a*, 42*b* of the first clamp 42, are spaced apart from one another, thereby defining a slot 43*a* therebetween which communicates with the first pocket 43. The second clamp 44 includes a first tapered side portion 44*a* and a second tapered side portion 44*b* being opposed to the first side portion 44*a* and defining a second substantially cylindrical pocket 45 therebetween. Outermost ends of the first and second side portions 44*a*, 44*b* of the second clamp 44, are spaced apart from one another, thereby defining a slot 45*a* therebetween which communicates with the second pocket 45. The width of each slot 43*a*, 45*a* is less than the diameter of each cylindrical pocket 43, 45, respectively.

The second side 28 includes at least one, and preferably four, coaxial hinges 52, 54, 56, 58 spaced equidistantly along the second side 28, each hinge 52, 54, 56, 58 having a cylindrical lateral post 52*a*, 54*a*, 56*a*, 58*a*, each post 52*a*, 54*a*, 56*a*, 58*a* being integrally-molded with, and in spaced relation to, a second side end member 39, thereby defining a slot 52*b*, 54*b*, 56*b*, 58*b*, respectively, therebetween. The first hinge 52 is substantially opposed to the first clamp 42; the second hinge 54 is substantially opposed to the space 47 between the first and second clamps 42, 44, respectively; the third hinge 56 is substantially opposed to the second clamp 44; and, the fourth hinge 58 is substantially opposed to a step 49 provided downwardly adjacent the second clamp 44 between the second clamp 44 and the bottom side 24 of the wall segment 10.

Figure 3:
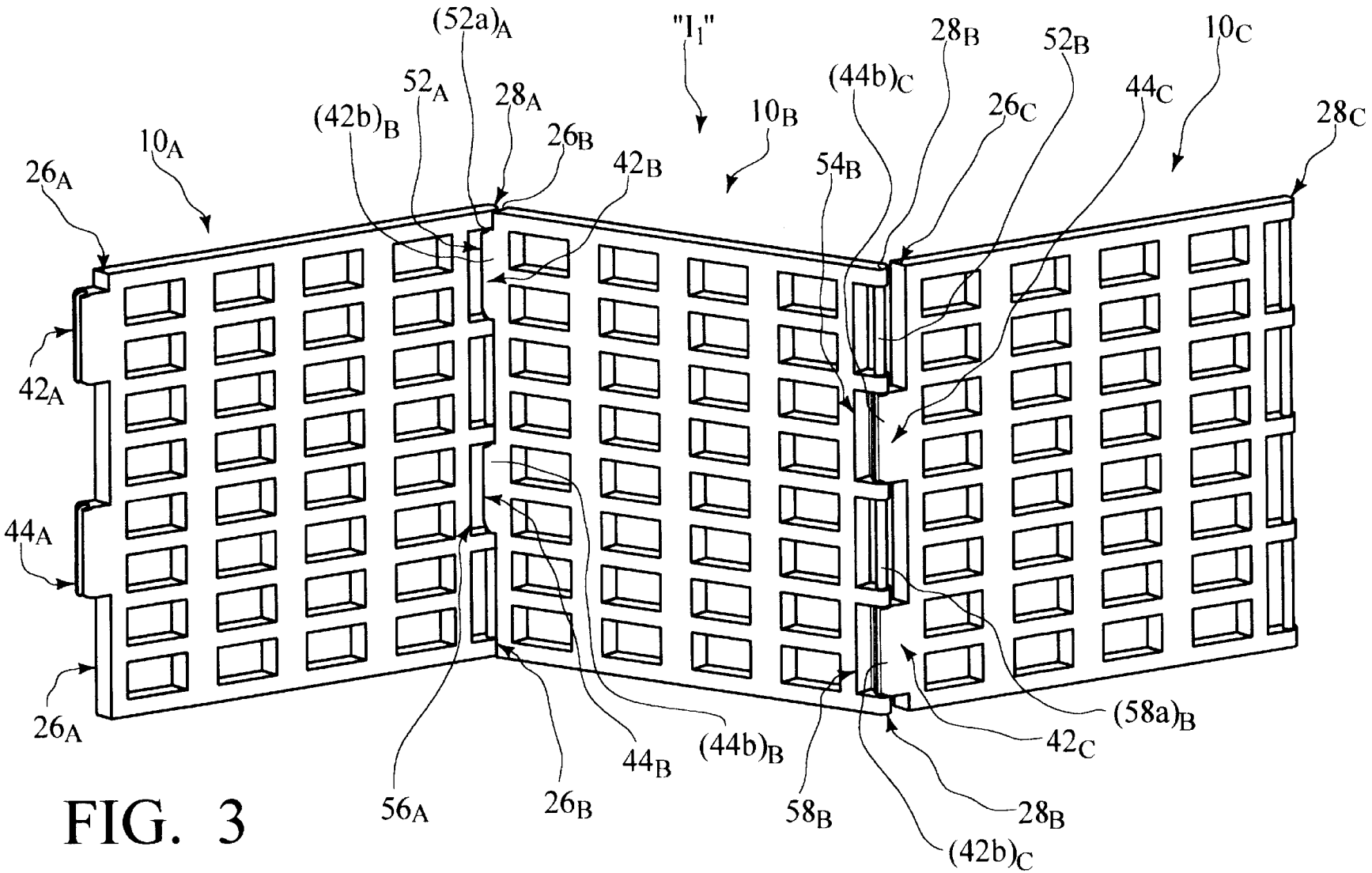
FIG. 3 is a perspective view of a plurality of cooler insert wall segments of FIG. 1, shown connected in one manner to form a removable cooler insert.

With additional reference to FIG. 3, three wall segments $\mathbf{10}_A$, $\mathbf{10}_B$, $\mathbf{10}_C$ are connected end-to-end in a first orientation to define a series-connected cooler insert "I". More particularly, the first side $\mathbf{26}_B$ of the second segment $\mathbf{10}_B$ is connected to the second side $\mathbf{28}_A$ of the first segment $\mathbf{10}_A$ and the first side $\mathbf{26}_C$ of the third segment $\mathbf{10}_C$ is connected to the second side $\mathbf{28}_B$ of the second segment $\mathbf{10}_B$. The first and second segments $\mathbf{10}_A$, $\mathbf{10}_B$ are oriented in an upright vertical position, such as shown in FIG. 1, and such that the first clamp $\mathbf{42}_B$ of the second segment $\mathbf{10}_B$ is aligned with the first hinge $\mathbf{52}_A$ of the first segment $\mathbf{10}_A$ and the second clamp $\mathbf{44}_B$ of the second segment $\mathbf{10}_B$ is aligned with the third hinge $\mathbf{56}_A$ of the first segment $\mathbf{10}_A$. The first post $(\mathbf{52}a)_A$ of the first segment $\mathbf{10}_A$ is inserted into the first pocket $\mathbf{43}_B$ (not shown) of the second segment $\mathbf{10}_B$ through the first slot $(\mathbf{43}a)_B$ (not shown) and gripped therein by the first and second side portions $(\mathbf{42}a)_B$ (not shown), $(\mathbf{42}b)_B$ of the first clamp $\mathbf{42}_B$ of the second segment $\mathbf{10}_B$. The third post $(\mathbf{56}a)_A$ (not shown) of the first segment $\mathbf{10}_A$ is inserted into the second pocket $\mathbf{45}_B$ (not shown) of the second segment $\mathbf{10}_B$ through the second slot $(\mathbf{45}a)_B$ (not shown) and gripped therein by the first and second side portions $(\mathbf{44}a)_B$ (not shown), $(\mathbf{44}b)_B$ of the second clamp $\mathbf{44}_B$ of the second segment $\mathbf{10}_B$. The first and second side portions $(\mathbf{42}a)_B$, $(\mathbf{42}b)_B$ and $(\mathbf{44}a)_B$, $(\mathbf{44}b)_B$, respectively, of the clamps $\mathbf{42}_B$, $\mathbf{44}_B$ are received by the slots $(\mathbf{52}b)_A$, $(\mathbf{56}a)_A$ of the first and third hinges $\mathbf{52}_A$, $\mathbf{56}_A$, respectively, of the first segment $\mathbf{10}_A$. The second segment $\mathbf{10}_B$ is thereby hingedly connected to and pivotably moveable relative to the first segment $\mathbf{10}_A$.

The third segment $\mathbf{10}_C$ may be oriented in an inverted vertical position such that the first clamp $\mathbf{42}_C$ of the third segment $\mathbf{10}_C$ is aligned with the fourth hinge $\mathbf{58}_B$ of the second segment $\mathbf{10}_B$ and the second clamp $\mathbf{44}_C$ of the third segment $\mathbf{10}_C$ is aligned with the second hinge $\mathbf{54}_B$ of the second segment $10_B$. The fourth post $(58a)_B$ of the second segment $10_B$ is inserted into the first pocket $43_C$ (not shown) of the third segment $10_C$ through the first slot $(43a)_C$ (not shown) and gripped therein by the first and second side portions $(42a)_C$ (not shown), $(42b)_C$ of the first clamp $42_C$ of the third segment $10_C$. The second post $(54a)_B$ (not shown) of the second segment 10*B* is inserted into the second pocket $45_C$ (not shown) of the third segment $10_C$ through the second slot $(45a)_C$ (not shown) and gripped therein by the first and second side portions $(44a)_C$ (not shown), $(44b)_C$ of the second clamp $44_B$ of the third segment $10_C$. The first and second side portions $(42a)_C$, $(42b)_C$ and $(44a)_C$, $(44b)_C$, respectively, of the clamps $42_C$, $44_C$ are received by the slots $(52b)_B$, $(54a)_B$ of the first and second hinges $52_B$, $54_B$, respectively, of the second segment $10_B$. The third segment $10_C$ is thereby hingedly connected to and pivotably moveable relative to the second segment $10_B$.

Alternatively, the third segment $10_C$ may be in an upright orientation, such as the first and second segments $10_A$, $10_B$, respectively, wherein the first clamp $42_C$ of the third segment $10_C$ is aligned with, and hingedly connected to, the first post $(52a)_B$ of the second segment $10_B$ and the second clamp $44_C$ of the third segment $10_C$ is aligned with, and hingedly connected to, the third post $(56a)_B$ of the second segment $10_B$.

Any number of wall segments 10 may be connected end-to-end as hereinabove described to define a series-connected cooler insert "I" having a corresponding shape, size and length of a planar-sided, open or closed polygon.

Figure 4:
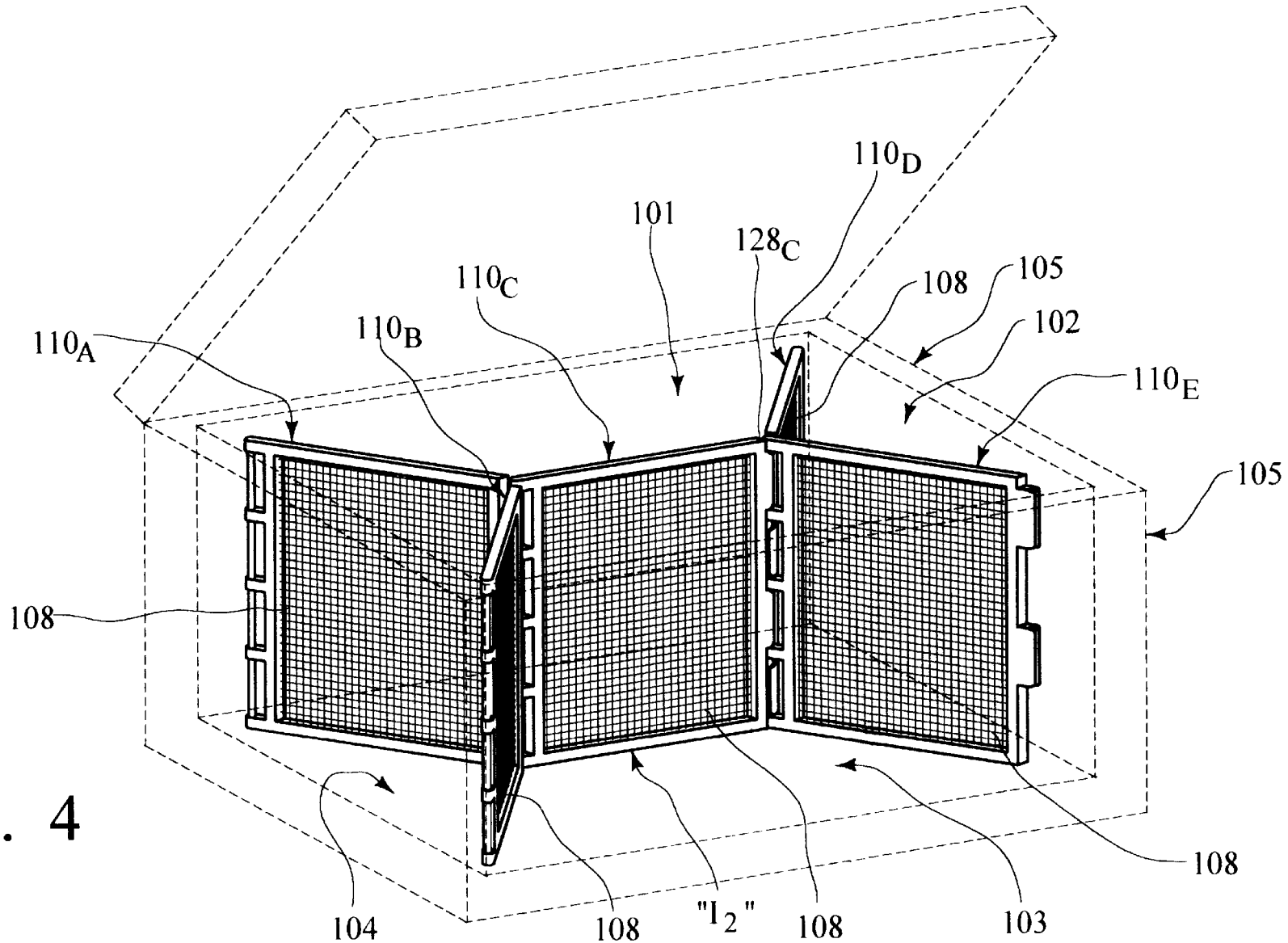
FIG. 4 is a perspective view of a plurality of cooler insert wall segments of FIG. 1, shown connected in one manner to form a removable cooler insert, wherein the removable cooler insert is shown inserted into a cooler shown in phantom.

With reference to FIG. 4, one particular application of the present invention is shown, wherein five wall segments $110_A$, $110_B$, $110_C$, $110_D$, $110_E$ according to another embodiment of the present invention are shown connected in another orientation to define a cooler insert "$I_2$" which is particularly useful to define a number of discrete storage regions 101, 102, 103, 104 within an internal storage chamber of a typical cooler 105. Screen members 32, 34 of the preferred embodiment have been replaced in the present embodiment with either a fine or a course mesh fabric 108 constructed from, such as, for example, nylon, polyethylene or polypropylene. The fabric 108 may be either integrally-formed with wall segment 110, or affixed thereto by any suitable means. Any suitable porous or continuous fabric or material may be used in place thereof which permits heat transfer therethrough, while physically containing the ice cubes in their respective desired regions.

Wall segment $110_A$, $110_B$ are each oriented in an upright vertical position and wall segment $110_A$ is hingedly connected to the first and third hinges (not shown) of wall segment $110_B$ as hereinabove described. Wall segment $110_C$ is oriented in an inverted vertical position and hingedly connected to the second and fourth hinges (not shown) of wall segment $110_B$ as hereinabove described. In like manner, wall segments $110_D$, $110_E$ are hingedly connected to the second side $128_C$ of wall segment $110_C$. Each wall segment $110_A$, $110_B$, $110_C$, 110D, $110_E$ is independently moveable with respect to the wall segment to which it is hingedly connected. Ice cubes (not shown) may be deposited in, for example, regions 101, 103 and food articles (not shown) may be deposited in the remaining regions 102, 104.

With particular reference to regions 102, 104, a large food article, such as, for example, a 2-liter bottle of carbonated beverage (not shown) requiring frequent removal from, and depositing into, the internal storage chamber of the cooler 105 may be deposited therein and permitted to contact the ice cubes through the center portions of wall segments $110_D$, $110_E$, thereby maintaining the bottle at a substantially chilled, constant temperature. The fabric screen 108 permits ice to contact the bottle through small openings (not shown) therethrough, but prevents ice from sliding therethrough into region 102. Further, removal of the bottle from region 102 will not cause the ice cubes to fall therein, due to the wall segments $110_D$, $110_E$. The bottle is therefore capable of being deposited back into region 102 without obstruction by the ice contained in regions 101, 103. Any number of wall segments may be connected in any number of ways to define an insert to provide various storage regions within a cooler having any number of sizes, shapes and geometries. Further, the cooler insert "$I_2$" may be disassembled and reassembled into any number of a variety of shapes, sizes and geometries as hereinabove described.

Alternatively, horizontal screen members 32 (FIG. 3) may be provided without vertical screen members 34 (FIG. 3), or vertical screen members 34 may be provided without horizontal screen members 32, wherein openings 36 are substantially slot-shaped.

Figure 6:
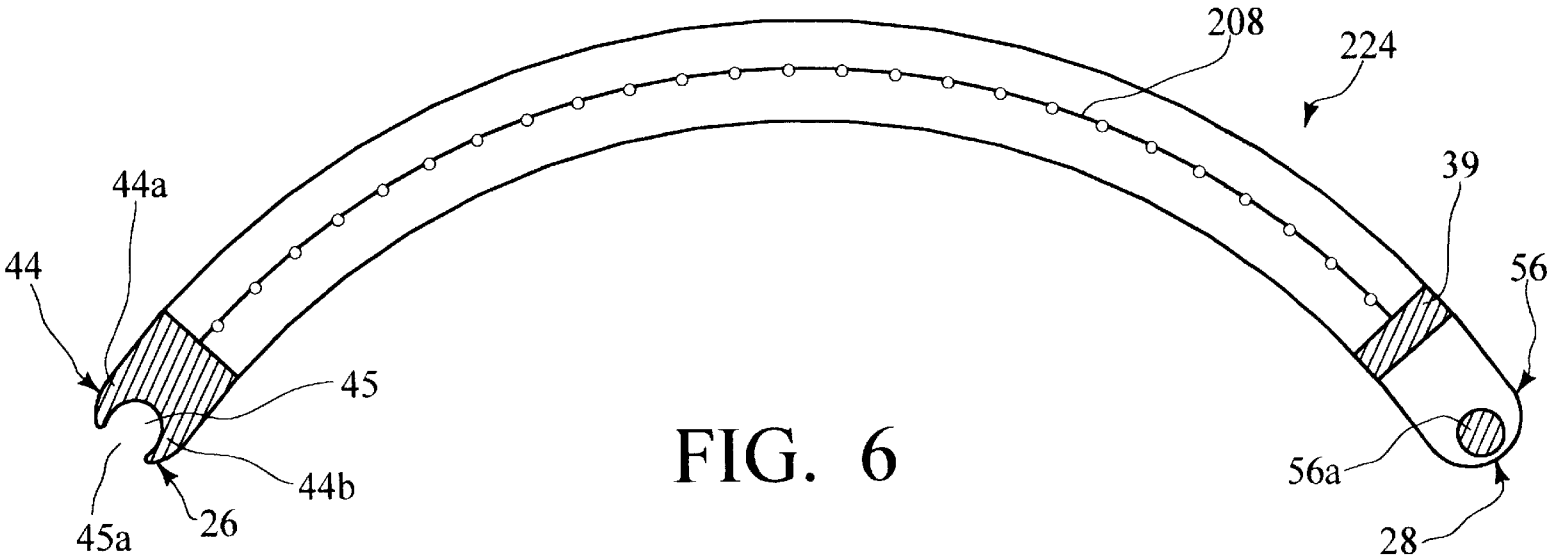
Figure 5:
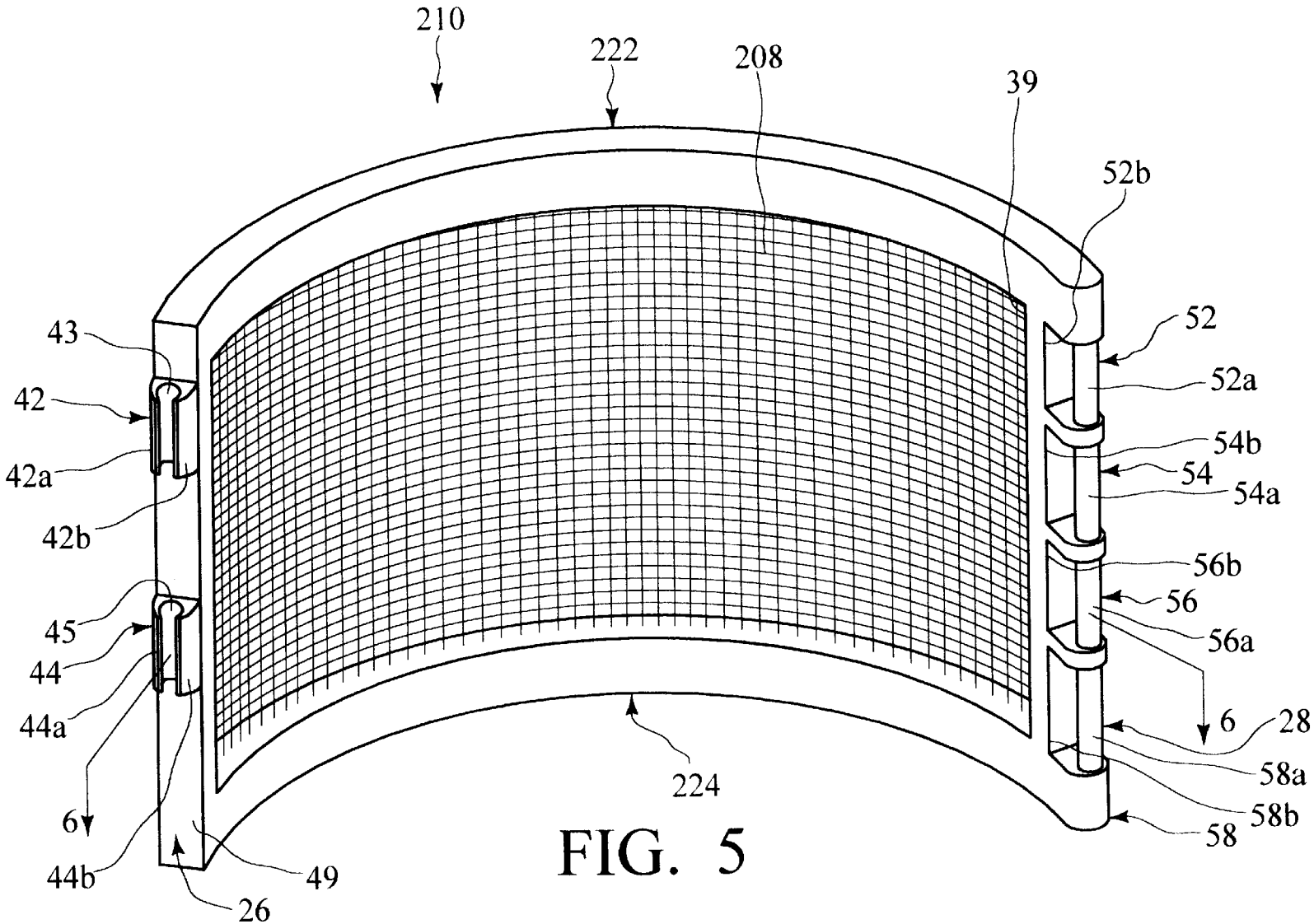
FIG. 5 is a perspective view of a cooler insert wall segment according to another embodiment of the present invention; and, FIG. 6 is a section view of the cooler insert wall segment of FIG. 5 shown along section line 6—6 of FIG. 5.

With reference to FIGS. 5 and 6, a cooler insert wall segment 210 according to another embodiment of the present invention includes many components in common with those components of the preferred embodiment hereinabove described and like reference numerals are intended to represent like components. However, the wall segment 210 according to the present embodiment includes arcuate top and bottom sides 222, 224. Further, a mesh fabric 208 is provided in a center portion of the wall segment 210. Any number of wall segments 210 may be connected end-to-end to form a closed, round-shaped insert (not shown) or may be combined with other planar wall segments 10 to form a complex shape.

Alternatively, the cooler insert wall segment according to any of the embodiments described herein may be constructed from a flexible material which permits the wall segment to be formed into an infinite number of shapes, such as, for example, an "S" shape, and to closely conform to the shape of nearly any food article positioned nearby. For example, the wall segment may be constructed from a bendable, plastically-deformable material which substantially retains its shape after forming and which permits later re-forming of the wall segment into other shapes.

Any number of wall segments may be combined in any suitable arrangement to provide any number of storage regions within a cooler storage chamber. For example, although FIG. 4 shows an arrangement wherein a food article may be deposited in a storage region, such as, storage region 104, having two storage regions adjacent thereto, such as storage regions 101, 103, the wall segments may be arranged such that a storage region defined thereby has more than two storage regions adjacent thereto.

Any conventional means known to one skilled in the art may be used to hingedly connect the wall segments together without departing from either the spirit or the scope of the present invention. For example, a continuous, slip, flag, spring, latch or concealed hinge of any type known to one skilled in the art.

Although the present invention has been described in terms of specific embodiments set forth in detail, it should be understood that this is by illustration only and that the present invention is not limited thereto, since alternative embodiments not described herein will become apparent to those skilled in the art in view of the disclosure. Accordingly, modifications are contemplated which can be made without departing from either the spirit or the scope of the present invention as described herein.

I claim:

1. A cooler insert wall segment, consisting of:

a top side;

a bottom side being in spaced relation to said top side;

a first side connecting a first distal end of said top side to a first distal end of said bottom side;

a second side being in spaced relation to said first side, said second side connecting a second distal end of said top side to a second distal end of said bottom side, said top side, said bottom side, said first side and said second side cooperating to define a center portion therebetween;

two first hinge members projecting outwardly from said first side, one of said first hinge members being positioned along a top portion of said first side and a second of said first hinge members being positioned downwardly adjacent a mid-point of said first side, said two first hinge members cooperating to define a first space therebetween, said first side having a second space defined downwardly from the second of said first hinge members and adjacent a bottom portion of said first side, said first hinge members and each of said spacings being of the same length, each of said first hinge members includes first and second opposed side portions, said first side portion and said second side portion being in spaced relation to one another and defining a post-receiving pocket therebetween, each of said first side portion and said second side portion being tapered toward a terminating end, said first and said second side portions converging toward said terminating ends, said terminating ends defining an opening therebetween in alignment with said first side;

four second hinge members provided in said second side, said four second hinge members being spaced equidistantly along said second side, two of said second hinge members being opposed to said two first hinge members and two of said second hinge members being opposed to said first and second spaces, each of said second hinge members includes a post and a clamp-receiving slot provided through said cooler insert wall segment between said post and said center portion; and, said cooler insert wall segment being receivable by a cooler to define a discrete storage region within a storage chamber provided in said cooler.

2. The cooler insert wall segment according to claim 1, said center portion including:

a plurality of horizontal screen members connecting said first side to said second side, said plurality of horizontal screen members being in spaced relation to one another between said top side and said bottom side; and, a plurality of vertical screen members connecting said top side to said bottom side, said plurality of vertical screen members being in spaced relation to one another between said first side and said second side, said plurality of vertical screen members intersecting each of said horizontal screen members to define a plurality of openings through said wall segment.

3. The cooler insert wall segment according to claim 2, each of said plurality of openings being sized to prevent ice cubes from passing therethrough.

4. The cooler insert wall segment according to claim 1, said cooler insert wall segment being substantially planar.

5. The cooler insert wall segment according to claim 1, said cooler insert wall segment being integrally molded.

6. The cooler insert wall segment according to claim 1, said cooler insert wall segment being flexible.

7. A cooler insert, consisting of:

a plurality of cooler insert wall segments, said plurality of cooler insert wall segments each having a top side, a bottom side being in spaced relation to said top side, a first side connecting a first distal end of said top side to a first distal end of said bottom side, a second side being in spaced relation to said first side, said second side connecting a second distal end of said top side to a second distal end of said bottom side, said top side, said bottom side, said first side and said second side cooperating to define a center portion therebetween, two first hinge members projecting outwardly from said first side, one of said first hinge members being positioned along a top portion of said first side and a second of said first hinge members being positioned downwardly adjacent a mid-point of said first side, said two first hinge members cooperating to define a first space therebetween, said first side having a second space defined downwardly from the second of said first hinge members and adjacent a bottom portion of said first side, said first hinge members and each of said spacings being of the same length, each of said first hinge members includes first and second opposed side portions, said first side portion and said second side portion being in spaced relation to one another and defining a post-receiving pocket therebetween, each of said first side portion and said second side portion being tapered toward a terminating end, said first and said second side portions converging toward said terminating end, said terminating ends defining an opening therebetween in alignment with said first side; and, four one second hinge members provided in said second side, said four second hinge members being spaced equidistantly along said second side, two of said second hinge members being opposed to said two first hinge members and two of said second hinge members being opposed to said first and second spaces, each of said second hinge members includes a post and a clamp-receiving slot provided through said cooler insert wall segment between said post and said center portion;

said plurality of cooler insert wall segments including a first wall segment and a second wall segment, said at least one first hinge member of said second wall segment being hingedly connected to said at least one second hinge member of said first wall segment; and, said cooler insert being receivable by a cooler to define a discrete storage region within a storage chamber provided in said cooler.

8. The cooler insert according to claim 7, said center portion of said cooler insert wall segment including:

a plurality of horizontal screen members connecting said first side to said second side, said plurality of horizontal screen members being in spaced relation to one another between said top side and said bottom side; and, a plurality of vertical screen members connecting said top side to said bottom side, said plurality of vertical screen members being in spaced relation to one another between said first side and said second side, said plurality of vertical screen members intersecting each of said horizontal screen members to define a plurality of openings through said wall segment.

9. The cooler insert according to claim 7, each of said plurality of openings being sized to prevent ice cubes from passing therethrough.

10. The cooler insert according to claim 7, said cooler insert wall segment being substantially planar.

11. The cooler insert according to claim 7, said cooler insert wall segment being integrally molded.

12. The cooler insert according to claim 7, said cooler insert wall segment being flexible.

* * * * *